US006241014B1

(12) United States Patent
Majek et al.

(10) Patent No.: US 6,241,014 B1
(45) Date of Patent: Jun. 5, 2001

(54) PLUNGER LIFT CONTROLLER AND METHOD

(75) Inventors: Alfred Majek, Fulshear; Ian Dees, Houston; Marina Drobnic, Stafford; Chris Fields, Houston, all of TX (US)

(73) Assignee: Texas Electronic Resources, Inc.

( * ) Notice: Subject to any disclaimer, the term of this patent is extended or adjusted under 35 U.S.C. 154(b) by 0 days.

(21) Appl. No.: 08/911,326

(22) Filed: Aug. 14, 1997

(51) Int. Cl.[7] ..... E21B 43/12

(52) U.S. Cl. ..... 166/53; 166/372; 364/143

(58) Field of Search ..... 166/53, 372, 370; 364/143, 145

(56) References Cited

U.S. PATENT DOCUMENTS 4,352,376 * 10/1982 Norwood ..... 137/624.15
5,132,904 * 7/1992 Lamp ..... 364/422
5,146,991 * 9/1992 Rogers ..... 166/369

* cited by examiner

*Primary Examiner*—David Bagnell
*Assistant Examiner*—Zakiya Walker
(74) *Attorney, Agent, or Firm*—David M. Ostfeld

(57) ABSTRACT

A microprocessor-based controller for oil or gas wells using a plunger lift device is disclosed, which responds to variations in the well production and operation through a series of input signals derived from the well operation. The controller will automatically make corrections in the operation times and cycles to maximize the well performance and maintain environmental safety.

31 Claims, 8 Drawing Sheets

PLUNGER LIFT CONTROLLER AND METHOD

BACKGROUND OF THE INVENTION

1. Field of the Invention

The invention relates to the control of oil and gas wells using a plunger lift device and more particularly to adjustable control of such wells.

2. Background

Several technologies are used to assist the production of fluids from crude oil or natural gas wells. One of these involves the use of a plunger, a free moving rod or sealed tube with loose-fitting seals to prevent fluid bypassing between the plunger and the production tubing wall. The plunger is left at the bottom of the well until sufficient pressure has built up to allow the plunger to rise to the top of the well head, pushing the accumulated fluid ahead of the plunger. Movement of the plunger is normally controlled by opening a valve at the well head, connecting the tubing to an outlet line, such as the sales line or in some cases separation equipment used to separate oil, water, and gas. The principle of operation is based on the well slowly building up bottom hole pressure from fluids and gas passing from the formation into the well. When the sales valve is opened, the pressure in the sales line or separator is lower than the bottom hole pressure, so that the pressure differential causes the plunger to travel to the surface. In some instances it is desirable to leave the sales valve open for a period of time after the plunger has arrived at the surface. This time period is frequently referred to as "Afterflow." There are several conditions under which it is desirable not to operate the sales valve for safety or production efficiency reasons. For example, the sales line pressure might be so high that one would not want to try to force more fluid or gas into an already loaded system.

History

The earliest devices which provided timing cycles for the sales valve were simple mechanical spring wound clock movements with pins or levers to open or close a pilot valve that would in turn operate a motor valve to operate the sales line. As technology advanced, these were superseded by battery-powered solid-state electronic timers such as the devices described in U.S. Pat. Nos. 4,150,721 and 3,445,746. These were then replaced by microprocessor-based units that could perform the same timing functions and also make limited changes in the time cycle based on outside influences. Such influences might include detecting the failure of the plunger to arrive in the expected time or observing high or low pressure limits through the use of external pressure switches such as the device described in U.S. Pat. No. 4,532,952. Further advances were made with the devices described in U.S. Pat. No. 5,146,991, which allowed production cycle changes based on the speed at which the plunger arrived at the well head.

SUMMARY OF THE PRESENT INVENTION

The present invention of a microprocessor based controller for oil or gas wells using a plunger lift device is addressed to an improved method for operating and controlling such an oil or gas well using the plunger system and procedures for assisted artificial lift of well fluids. Because of its flexibility and computational power, the modern microprocessor can perform a series of increasingly complex control algorithms as selected by the well operator. The controller can thus serve first as a manual control panel, performing operations on the oil or gas well only as directed by the human operator. The controller can serve as a simple low power timing device indicating elapsed times between various operations performed manually through the controller on the oil and gas well. The controller also may operate and control the well automatically, using the computational powers of the processor, changing various time intervals to adjust the ideal trip time set by the operator with changes in condition of the oil or gas well. In this mode the controller compares the actual trip time with the ideal trip time and changes Off time (the time after the trip is complete until the next trip) and/or Afterflow time by an exponential function of the difference between the actual trip time and the ideal trip time. Hence the change in the adjusted time will be large for large differences and small for small differences. Use of the exponential function calculation allows for rapid approach to the ideal trip time along a substantially asymptotic path while allowing correction on the next cycle for any overcompensation.

This microprocessor is preferably a battery-powered, solid-state electronic system with an associated set of program functions stored in nonvolatile memory connected by appropriate I/O to a well to permit improvement of the production efficiency of several different plunger lift applications. Additionally, the invention eases the human operator's burdens and improves safety of the equipment, environment, and personnel. Battery life may be extended with the addition of a photovoltaic panel, which may be mounted on top of the controller.

BRIEF DESCRIPTION OF THE DRAWINGS

For a better understanding of the nature and objects of the present invention, reference should be had to the following drawings in which like parts are given like reference numerals, and wherein.

DESCRIPTION OF THE PREFERRED EMBODIMENT OF THE PRESENT INVENTION

Figure 1:
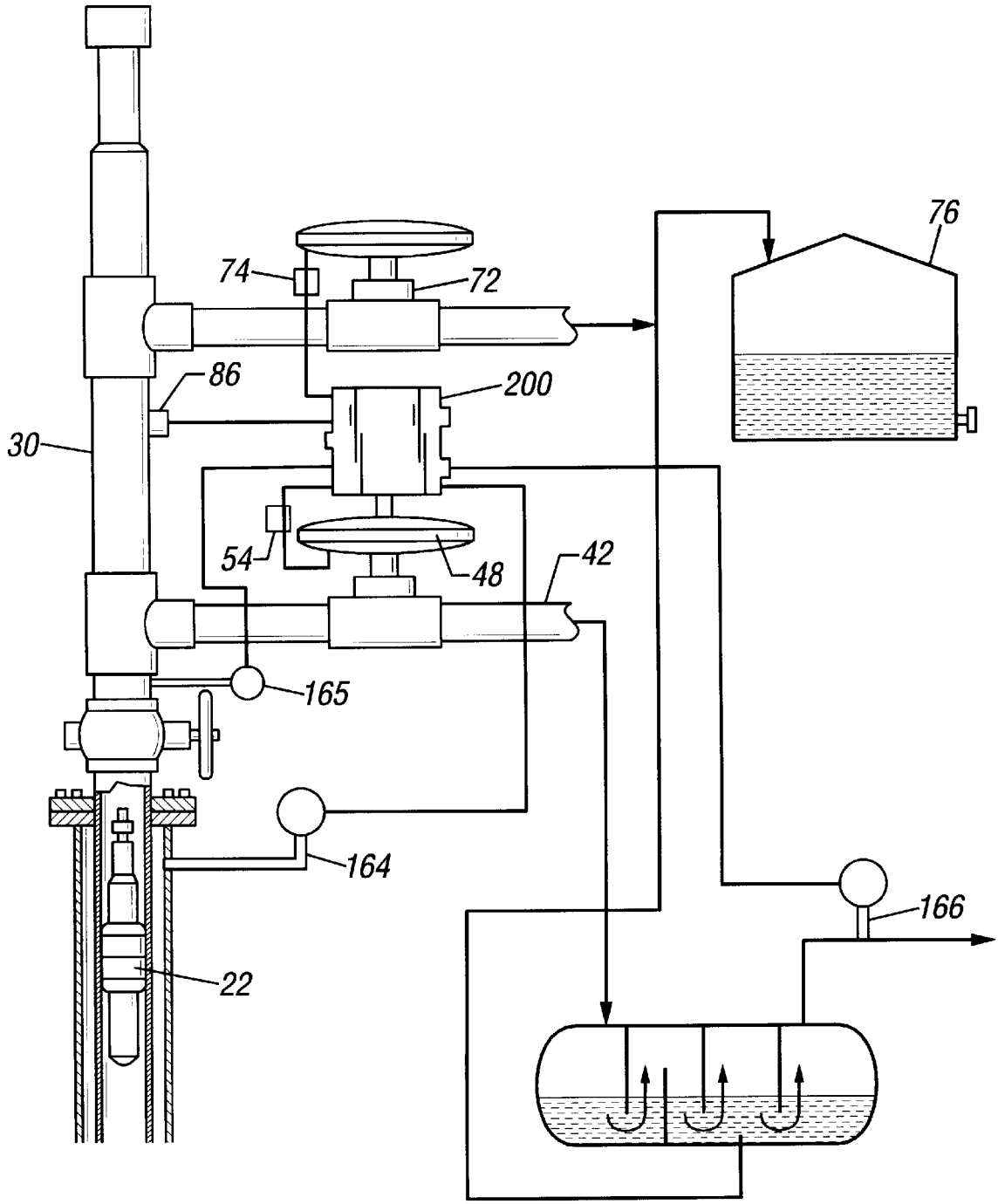
FIG. 1 is a sectional schematic of a typical well installation for use with the preferred embodiment of the present invention, such well installation including a separator and a low pressure storage tank, the components of such well installation being shown sectionally and out of scale.

Referring to FIGS. 1–6, there is shown a well 30 having a production system for recovering oil or gas which includes production casing 6. At the lower end 7 of production casing 6 there is mounted a plunger receiver 8 which receives a plunger 22 thereon which rests on receiver 8.

Plunger 22 reciprocates within the interior 23 of production casing 6 between receiver 8 and a plunger detector 86 located at top of the well 30. The sales line 42 is also connected to the interior 23 of well 30, with the flow through sales line 42 governed by a valve 48. The actuation of valve 48 is through fluid flow line 49 connected to diaphragm 51 by solenoid valve 54.

Figure 2:
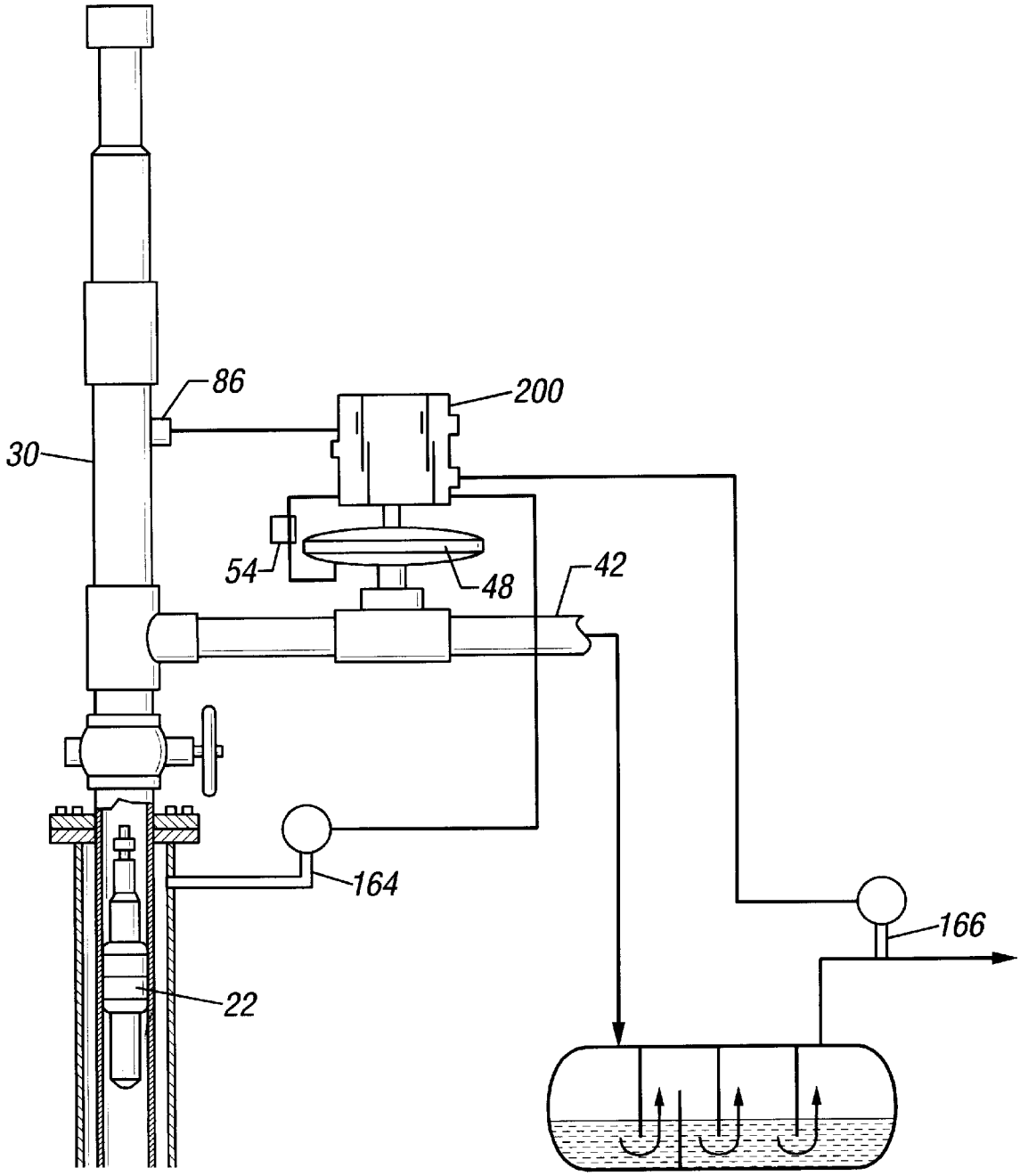
FIG. 2 is a sectional schematic of a typical well installation for use with the preferred embodiment of the present invention, such well installation including a separator but not a low pressure storage tank, the components of such well being shown sectionally and out of scale.
Figure 3:
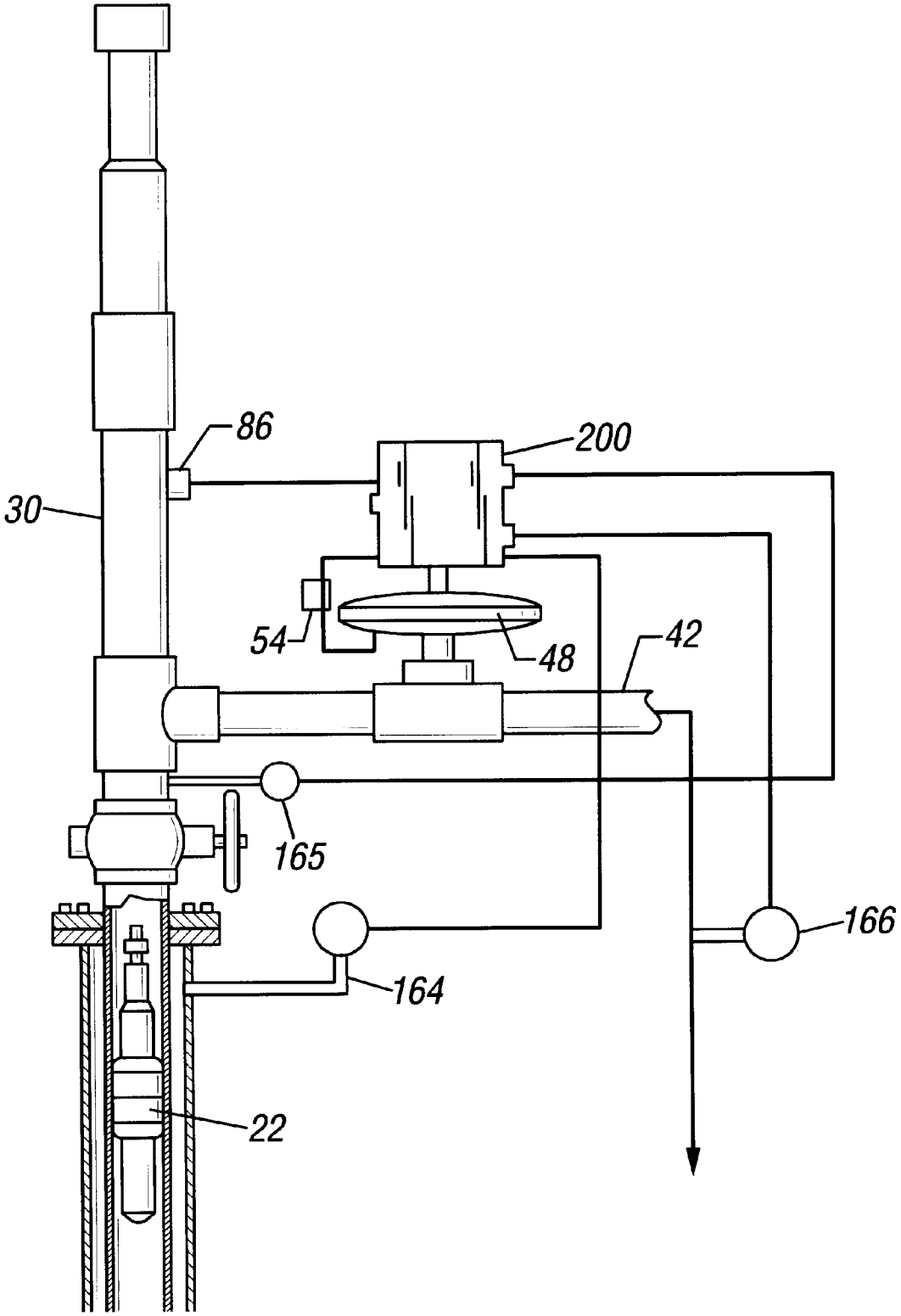
FIG. 3 is a sectional schematic of a typical well installation for use with the preferred embodiment of the present invention, such well installation including the well connected directly to the sales line, the components of such well shown sectionally and out of scale.
Figure 4:
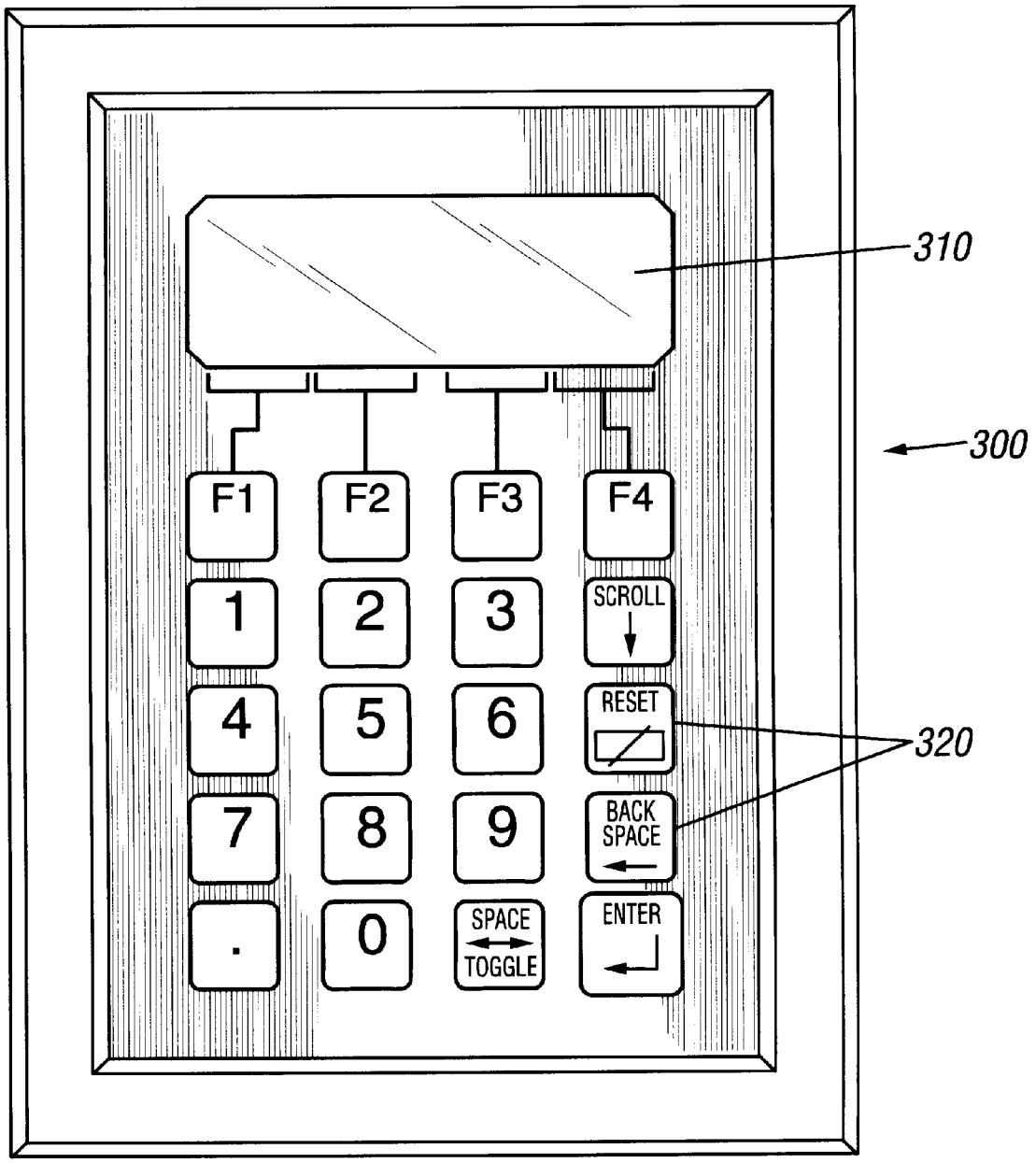
FIG. 4 is a pictorial representation of the front panel of the controller of the preferred embodiment of the present invention.
Figure 5A:
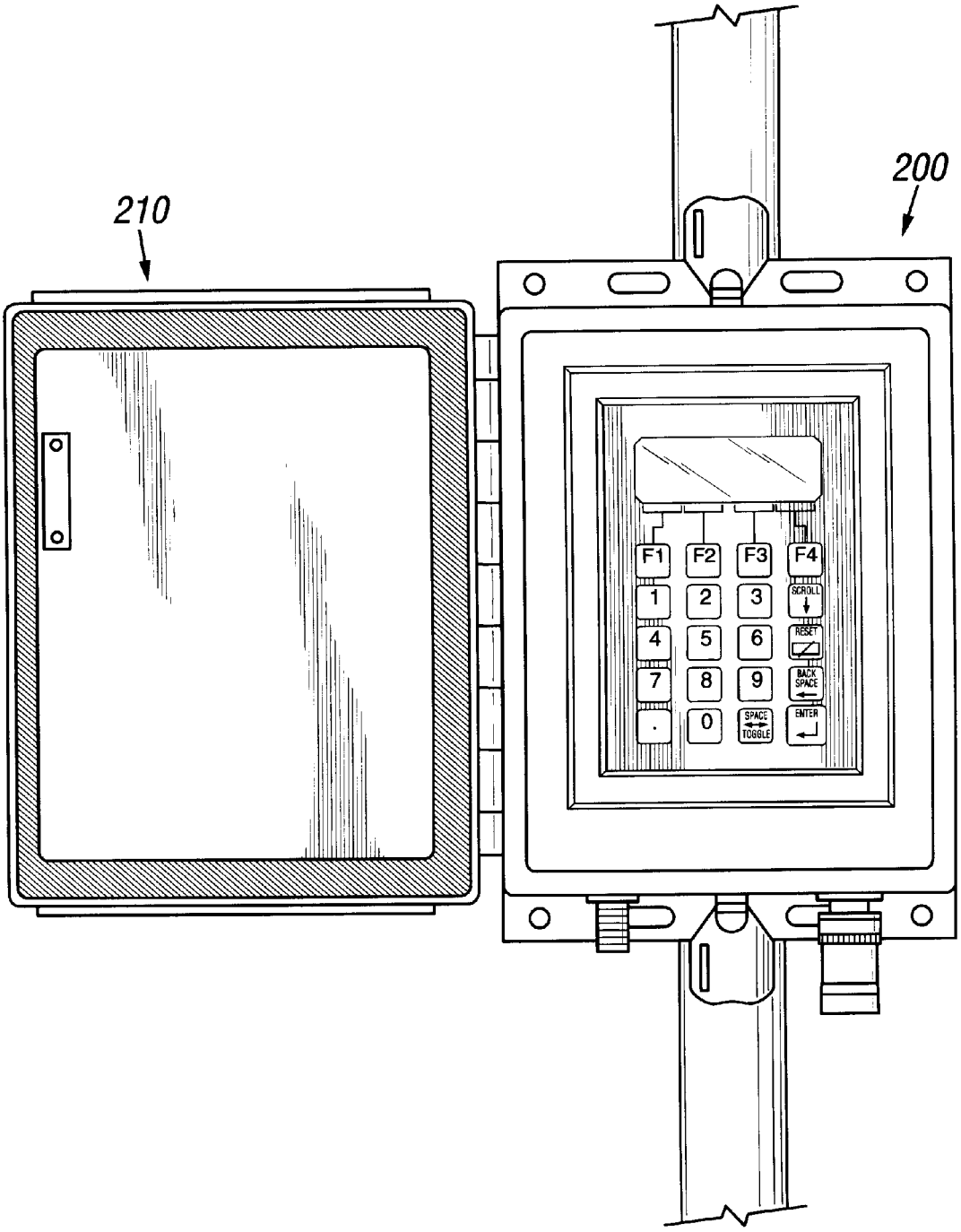
FIG. 5A is a front view pictorial of the preferred embodiment of the present invention.
Figure 5B:
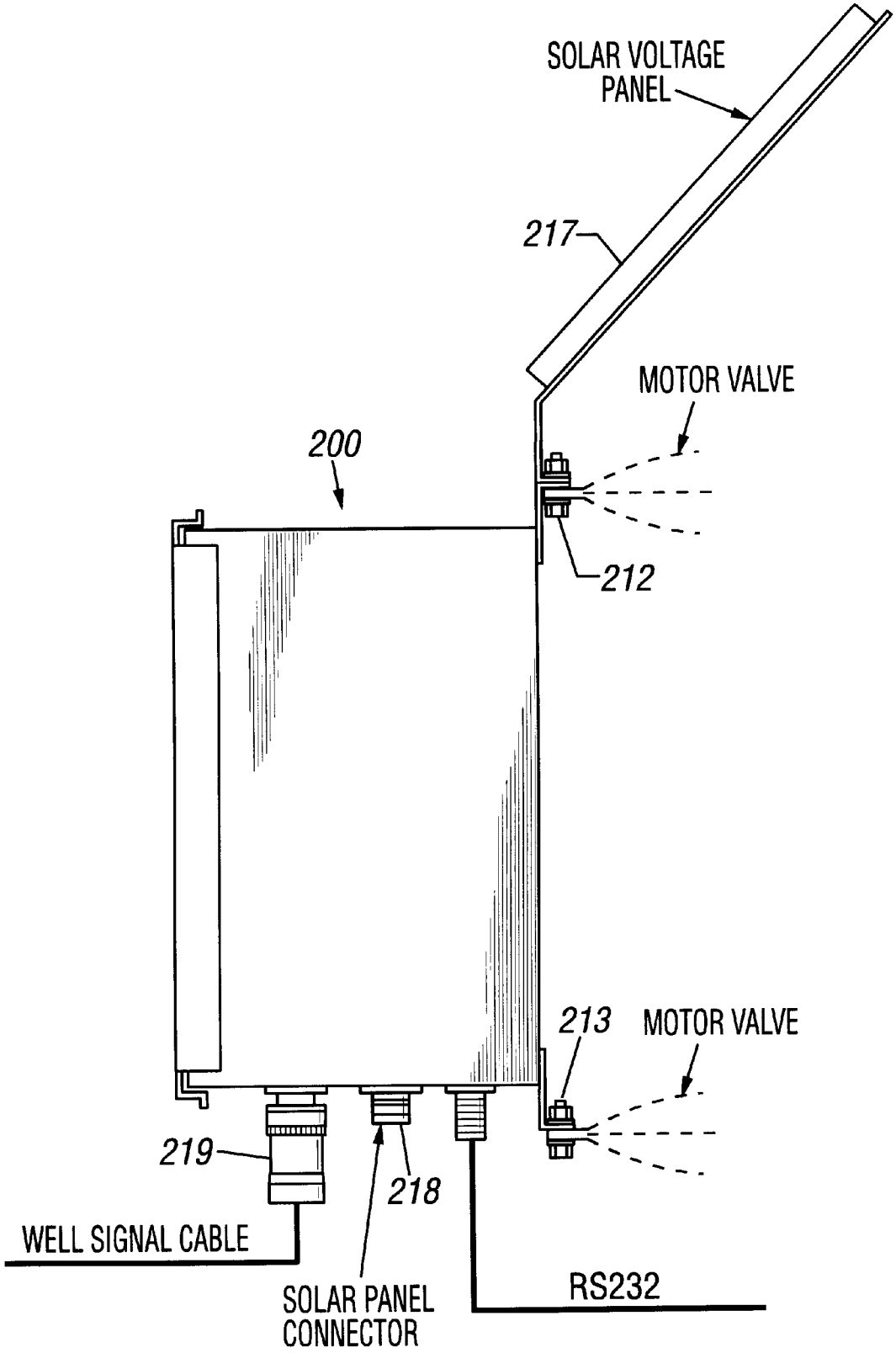
FIG. 5B is a side view pictorial of the preferred embodiment of the present invention including the solar power supply.
Figure 5C:
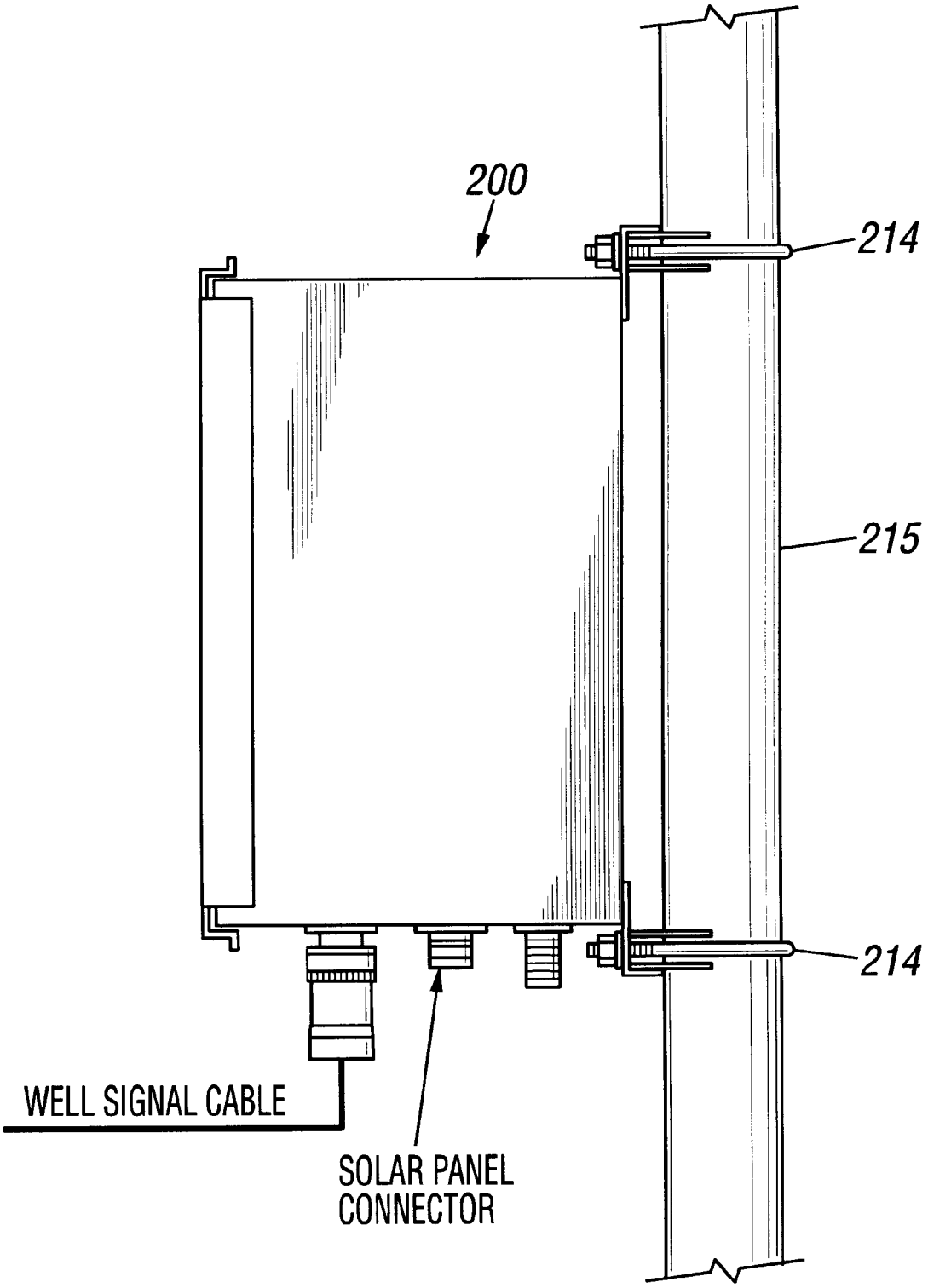
FIG. 5C is a side view pictorial of the preferred embodiment of the present invention.
Figure 6:
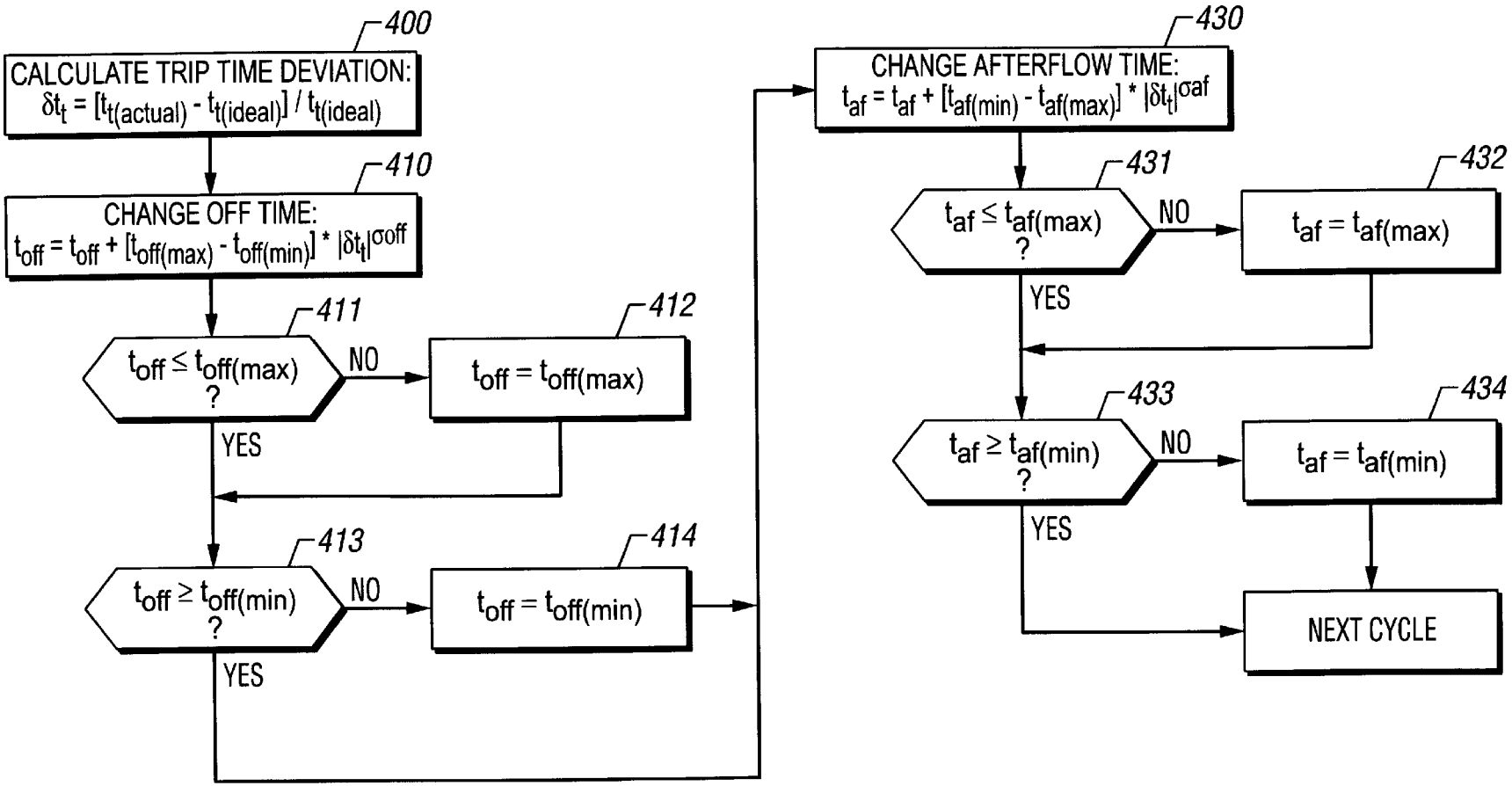
FIG. 6 is a logic flow diagram of the SMART MODE operation sequence of the controller of the preferred embodiment of the present invention.

Optionally, well 30 may further include an annular tubing outlet line 71 (FIG. 1), the flow through which is regulated by valve 72 having diaphragm 73 operated by fluid line 75 connected to diaphragm 73 and regulated by solenoid valve 74 contained in and mounted on line 75. Outlet line 71 may be connected to low pressure storage 76 (FIG. 1). Further, as shown in FIGS. 1 and 2, sales line 42 may be connected to a separator 77. For the well configuration of FIG. 1, liquids from separator 77 flow through liquids line 79 to low storage 76, joining the effluent of line 71. The gas from separator 77 may flow by line 81 to the outlet for sales.

A controller 200 is electrically connected to detector 86 by line 58 and to solenoid 54 by line 55. Further, in the case of FIG. 1, controller 200 would be electrically connected to solenoid 74 by line 83. Controller 200 includes a well signal cable 219, such cable 219 containing the input and output connections discussed above. Controller 200 also includes an enclosure 201.

The controller 200 is self-contained and housed in enclosure 201 for use in the harshest remote outdoor sites. Controller 200 is microprocessor based, shown pictorially by indicator 302, to which is connected well signal cable 219. Cable 219 may include the above described signal lines 55, 58, 83 for well 30. Also mechanically mounted in controller 200 and connected to microprocessor 302 is a 20-button key pad 320 with a four line, 20 characters alphanumeric per line Liquid Crystal Display ("LCD") 310, all mounted as part of front panel, human interface 300 or control panel. Typically, controller 200 will have provisions for four status inputs (switch contact closures), four analog input signals (voltage or current signals proportional to a variable, e.g. pressure) and a multiplexer, a communications port 220 meeting RS232 requirement, and outputs to control two latching solenoid valves, such various input and output to a microprocessor through an input and output module being well known in the art. The controller 200 also has a low power real time clock. Thus, the controller 200 through the sensing of detector 86 by line 58 and control of the sales line valve 48 by line 55 will use the real time clock, store and display on command the last ten trip times (by subtracting from the time of the plunger arrival as detected by detector 86 from the time of opening of sales line valve 48 for each such trip), the total time spent with the sales valve closed (by subtracting the time of opening of sales line valve 48 from the last time sales line valve 48 was closed), the total time with the sales valve open (by subtracting the time the sales line valve 48 is closed from the last time the sales line valve 48 was opened), the number of plunger arrivals (by counting the number of times detector 86 senses arrival of plunger 8), and the number of failed arrivals (by using the real time clock to calculate the difference between the current time and the time of opening of the sales line valve 48 and comparing this difference to a preset value in the microprocessor so that when the difference exceeds such preset value without detector or transducer 86 having detected the arrival of plunger 22, a total is kept as well as individual instances being kept in the memory as a failed arrival. (It should be noted that each of the items would be kept and discarded on a circular file or integer size basis for each of the items described above.) The controller 200 also includes a 12 volt battery acting as its power supply.

Under normal operation, the controller 200 acts in a low power mode, during which it continues to monitor the inputs from well 30 but minimizes power consumption by disabling portions of the microprocessor and display panel. The controller 200 is activated when the door 210 is opened, or when any of the status inputs change state (e.g., the plunger 22 arrival as indicated by transducer 86 detecting of the plunger 22 or a high or low alarm limit switch closes, such as casing pressure switch 164 connected to controller 200 by line 167 or inner well pressure switch 165 connected to controller 200 by line 168 or discharge pressure switch 166 for sales line 81 connected to controller 200 by line 169), the communication port 220 detects the presence of a carrier signal, or the low power real time clock signals the completion of the current timing interval.

For abnormal operation, the LCD 310 flashes a warning every three seconds when the battery (not shown) is low. Other alarm conditions are displayed on the status screen LCD 310.

Access to the stored data via the data entry or key pad 320 can be operationally controlled by a password code as is well known in the art. Without a password code programmed, any of the parameters can be modified in the controller 200. If a password has been programmed, four levels of access are available. The first level does not require the password and allows the user only to view the different system parameters which are as described more particularly below and the maximum time failed arrival interval described above, and historical data. If the password option for the controller 200 were used, the password must be entered to modify data or settings, as is well known in the art. If the password is entered correctly, the second level of security is enabled and all parameters and data may be modified or cleared. A third level of security may also be used for field supervisor access. This password would preferably be entered at the factory and would not be alterable in the field. This level of password would normally be used in case the field programmed password is lost or forgotten. The field supervisor access also allows the changing of the Smart System exponential variables as described below. Preferably, there is also a factory access level for diagnostics and testing.

The controller 200 is preferably enclosed in an 8"×10"×6" stainless steel enclosure 201 with a hinged front door or cover 210 that is latching and lockable. The control panel 300 is weatherproof and acts as the seal protecting the electronics inside the enclosure 201, even if the front cover 210 is left open. Electrical access is provided via three weatherproof electrical connectors 218, 219, 220 mounted on the bottom of the enclosure 201. The controller 200 may be mounted above or below the motor valve 48 using the mounting brackets 212, 213 that are part of the enclosure 201. The enclosure 201 may be mounted to a pipe or post 215 using U-bolts 214. A solar voltaic panel 217 may be connected to the internal electronics via the two-pin connector 218 on the under side of the enclosure 201. The mounting location of the solar panel 217 is left to the discretion of the installer, though it is frequently mounted on top of the enclosure 201. Electrical signals to and from the well 30 enter the enclosure 201 via the Well Signal cable connector 219. The latching electrically operated solenoid valve(s) 54, 74 are powered by 12 volt DC pulses ordering them to open or close, as is well known in the art. The solenoid valves 54, 74 are typically provided by the installer and are mounted external to the enclosure 201 and are connected to the controller 200 by field installed wiring via the well signal cable connector 219. The control solenoids provide gas or air to operate the motor valves 48, 72.

All time intervals, alarm limits and operation mode commands are entered or changed through the use of the key pad 320 and LCD 310. After entering the password (if one was programmed or used), the operator uses the scroll key 322 to reach the screen displaying the parameter to be set or changed, enters the new setting via the numeric key pad 320 and presses enter 323.

Operation Modes

Manual Mode: In manual mode, all functions are carried out by commands entered from the control panel 300. The display 310 flashes "Manual Mode" every three seconds to inform the user that the controller will not automatically control the well 30. In the manual mode all alarm signals are preferably ignored except the low battery condition. The manual mode would most frequently be used to take the well 30 out of production for extended periods of time.

Auto Mode: The device acts as an electronic timer. The operator enters On time, Off time, and Backup time. During the On time cycle, the sales valve 48 is held open, allowing fluid and gas to pass to the sales line 42. The controller 200 continues to alternate between the On and Off cycles unless the plunger 22 does not arrive during an On time. In this case of the failure for the plunger 22 to arrive, the controller 200 switches to a Backup time cycle. This additional Backup time cycle is generally longer than Off time and allows the well 30 to build up enough pressure to ensure a plunger 22 arrival on the next On time cycle. Backup time will replace the Off time when a plunger 22 arrival is not detected. The Backup cycle will also be activated if the low pressure contact of casing pressure switch 164 is detected, during an On, Afterflow, or Tank cycle. A high pressure contact of casing pressure switch 164 activation during an Off or Backup Cycle will begin an On cycle. If, during a cycle where the sales valve 48 or tank valve 72 is open, the sales gauge contact 166 detects a high pressure condition both valves will close and not reopen until the contact connection is broken. Additional timing states or cycles may be incorporated in the standard product base program library of controller 200 and may be optionally added to the basic Auto Mode operation. These optional cycles are:

(1) Afterflow cycle, during which the sales valve 48 is kept open after the plunger 22 has arrived. If the Afterflow cycle is used, a plunger 22 arrival during the On cycle causes the controller 200 to switch to Afterflow. The fluid flow is sufficient to keep the plunger 22 held in the lubricator part of well 30 at the top of the well 30 and out of the path to the sales line 42. At the end of the cycle, the sales valve 48 is closed and the controller 200 enters the Off cycle.

(2) Fall time, during which the High Pressure contact of casing pressure switch 164 is ignored while the plunger falls back to the bottom of the well 30.

(3) Tank time is another optional time interval, which is added to the On time. During the Tank time second valve 72 is opened to low pressure storage tank 76. This action provides an outlet for an unusual or additional quantity of fluid to be collected at or near atmospheric pressure and assist in relieving the well 30 of a fluid overload. If the plunger 22 arrives during the Tank cycle, the controller 200 switches to Off (or Afterflow time if the user specifies one). If the Tank cycle times out and a plunger 22 arrival has not been detected, the controller 200 will revert to a Backup time cycle replacing the Off cycle.

Smart System: This optional timing control is designed to maximize fluid production without the need for expensive pressure transducers. The operator establishes a nominal ideal plunger 22 trip time based on knowledge of the well, field, and geological formation from which the well is producing. The invention uses a variable mathematical algorithm, which modifies two control parameters to maintain the optimum trip time for plunger 22. The operator enters an ideal trip time, On time, minimum and maximum Off times, minimum and maximum Afterflow times, and starting Off and Afterflow times as defined above. The cycle starts with the plunger 22 at the bottom of the well 30. The controller 200 opens the sales valve 48 and starts the trip timer. When the plunger 22 is detected in the lubricator of well 30 by the plunger arrival sensor 86, the controller 200 then does the following calculations:

The trip time deviation is calculated 400 as a fraction of the ideal trip time:

$$\delta t_i=[t_{i(actual)}-t_{i(ideal)}]/t_{i(ideal)}.$$

The Off Time is changed 410 from the Off time of the previous cycle by $\Delta t_{off}$ $$\Delta t_{off}=[t_{off(max)}-t_{off(min)}]*\delta t_i^{\sigma off}.$$

The Afterflow time is then changed 430 from the previous Afterflow time by $\Delta t_{af}$ $$\Delta t_{af}=[t_{af(min)}-t_{af(max)}]*\ \delta t_i^{\sigma af}.$$

$t_{i(actual)}$, $t_{i(ideal)}$=actual ideal trip times $\delta t_i$=deviation from ideal trip time $t_{off(min)}$, $t_{off(max)}$=minimum and maximum Off times $t_{af(min)}$, $t_{af(max)}$=minimum and maximum Afterflow times $\Delta t_{off}$=amount to adjust Off time $\Delta t_{af}$=amount to adjust Afterflow time $\sigma_{off}$, $\sigma_{af}$=Off and Afterflow sensitivity coefficients The exponential function variables $\sigma_{off}$ and $\sigma_{af}$ are factory-set. Because the algorithm is based on an exponential function, the change in Off and Afterflow times will be greater for large differences from the Ideal Trip time and smaller for trip times close to the ideal. The adjustment of the parameters causes the well 30 control of plunger 22 to converge on the Ideal Trip time rapidly and will compensate for minor changes in the well's 30 condition to maintain the desired production. If the newly calculated Off Time or After-Flow time 411,413,431,433 exceeds the operator entered maximum or minimum limits, the appropriate limit 412, 414, 432, 434 is used for the next time interval.

Because many varying and different embodiments may be made within the scope of the invention concept taught herein which may involve many modifications in the embodiments herein detailed in accordance with the descriptive requirements of the law, it is to be understood that the details herein are to be interpreted as illustrative and not in a limiting sense.

What is claimed:

1. A controller to control production of a well using tubing and a plunger in the tubing and a plunger detector near the surface of the well and a valve between the tubing and an outlet line, comprising:

a microprocessor having an output connected to the valve and a clock and an input connected to the plunger detector;

said microprocessor having valve means to open the valve;

said microprocessor including inputs sensing the input of said clock and timing the amount of elapsed time from opening the valve until the plunger detector detects the presence of the plunger; and said microprocessor having means for setting a value for time until the valve is next opened, said value being set as a variable function of said amount of said elapsed time.

2. The controller of claim 1, wherein said microprocessor has means for setting a variable value for the amount of time until the next closing of the valve.

3. The controller of claim 2, wherein said function permits overdamped response.

4. The controller of claim 3, wherein said function is an exponential function.

5. The controller of claim 1, wherein there is further included a display, said microprocessor having outlets connected to said display.

6. The controller of claim 1, wherein said function permits overdamped response.

7. The controller of claim 6, wherein said function is an exponential function.

8. The controller of claim 1, wherein there is further included a human interface, said human interface connected to said microprocessor and having first means for displaying said elapsed time.

9. The controller of claim 8, wherein said human interface includes second means for initiating manual operation of said controller.

10. The controller of claim 9, wherein said second means includes third means for indicating to said microprocessor to open the valve.

11. The controller of claim 9, wherein said second means includes third means for indicating to said microprocessor to close the valve.

12. The controller of claim 1, wherein there is further included a communication port having means for reporting to a remote location the status of the well.

13. The controller of claim 1, wherein said microprocessor measures the elapse of sufficient time so that the plunger should have been detected; if it wasn't detected, said microprocessor recording the occurrence of said failure to detect the arrival of the plunger.

14. The controller of claim 1, wherein there is further included a housing and a human interface, said housing having a door covering said human interface and having two states, open and closed, said state of said door being open being an input to said microprocessor, said microprocessor having outputs activating said human interface when said door is open.

15. The controller of claim 14, wherein said microprocessor further includes a power supply and a detector for the power supply being low, said microprocessor having an input connected to the state of said low detector of said power supply, said microprocessor output activating said human interface to display the status of low power supply.

16. The controller of claim 1, wherein the well includes an alarm pressure switch and wherein said microprocessor is connected by an input to said switch, said microprocessor output detecting the activation of the alarm pressure switch.

17. The controller of claim 16, wherein said microprocessor suppresses said input detection of the alarm pressure switch during the time the plunger falls back to the bottom of the well.

18. The controller of claim 1, wherein there is further included a human interface, and wherein said microprocessor may change the values of said function upon receipt of a security code.

19. The controller of claim 1, wherein said microprocessor output maintains the valve open for a calculated period of time after the plunger is detected.

20. The controller of claim 1, wherein said function is:

$$\Delta t_{off}=[t_{off(max)}-t_{off(min)}]^{*}\ \delta t_{t}^{\sigma off},$$

wherein $t_{t(actual)}$, $t_{t(ideal)}$=actual and ideal trip times $\delta t_t$=deviation from ideal trip time and equal to $[t_{t(actual)}-t_{t(ideal)}]/t_{t(ideal)}$ $t_{off(min)}$, $t_{off(max)}$=minimum and maximum off times $\Delta t_{off}$=amount to adjust off time $\sigma_{off}$=off sensitivity coefficient.

21. The controller of claim 1, wherein said microprocessor output maintains the valve open for a period of time after the plunger is detected, said time for maintaining the valve open being a variable function of said amount of said elapsed time.

22. The controller of claim 21, wherein said microprocessor output maintains the valve open for a period of time after the plunger is detected, said time for maintaining the valve open being a function of said elapsed time, wherein said function is:

$$\Delta t_{af}=[t_{af(min)}-t_{af(max)}]^{*}\ \delta t_{t}^{\sigma af},$$

wherein $t_{t(actual)}$, $t_{t(ideal)}$=actual and ideal trip times $\delta t_t$=deviation from ideal trip time and equal to$[t_{t(actual)}-t_{t(ideal)}]/t_{t(ideal)}$ $t_{af(min)}$, $t_{af(max)}$=minimum and maximum afterflow times $\Delta t_{af}$=amount to adjust afterflow time $\sigma_{af}$=afterflow sensitivity coefficient.

23. A method of controlling production of a well having tubing and a plunger in the tubing and a plunger near the surface of the well and a valve between the tubing and an outlet line, comprising the steps of:

opening the valve;

timing the amount of elapsed time from opening the valve until the plunger detector detects the presence of the plunger;

closing the valve setting the time for the next opening of the valve as a variable function of said amount of said elapsed time.

24. The method of claim 23, wherein said function permits said setting the time to be a programmable damped response.

25. The method of claim 24, wherein said function is an exponential function.

26. The method of claim 25, wherein said function is:

$$\Delta t_{off}=[t_{off(max)}-t_{off(min)}]^{*}\ \delta t_{t}^{\sigma off},$$

wherein $t_{t(actual)}$, $t_{t(ideal)}$=actual and ideal trip times $\delta t_t$=deviation from ideal trip time, and is equal to $[t_{t(actual)}-t_{t(ideal)}]t_{t(ideal)}$ $t_{off(min)}$, $t_{off(max)}$=minimum and maximum off times $\Delta t_{off}$=amount to adjust off time $\sigma_{off}$=off sensitivity coefficient.

27. The method of claim 23, wherein there is further included the step of maintaining the valve open for a period of time after the plunger is detected.

28. The method of claim 27, wherein there is included the step of setting the time until the next closing of the valve as a variable function of said amount of said elapsed time.

29. The method of claim 28, wherein said function permits said setting the time to be a programmable damped response.

30. The method of claim 29, wherein said function is an exponential function.

31. The method of claim 30, wherein said function is:

$$\Delta t_{af}=[t_{af(min)}-t_{af(max)}]*\delta t_t^{\sigma af},$$

wherein $t_{t(actual)}$, $t_{t(ideal)}$=actual and ideal trip times $\delta t_t$=deviation from ideal trip time and equal to $[t_{t(actual)}-t_{t(ideal)}]/t_{t(ideal)}$ $t_{af(min)}$, $t_{af(max)}$=minimum and maximum afterflow times $\Delta t_{af}$=amount to adjust afterflow time $\sigma_{af}$=afterflow sensitivity coefficient.

* * * * *